US005114253A

United States Patent [19]

Yoshimoto

[11] Patent Number: 5,114,253

[45] Date of Patent: May 19, 1992

[54] DOT PRINTING METHOD FOR DOT PRINTER

[75] Inventor: Satoshi Yoshimoto, Komaki, Japan

[73] Assignee: Brother Kogyo Kabushiki Kaisha, Nagoya, Japan

[21] Appl. No.: 763,607

[22] Filed: Sep. 23, 1991

[30] Foreign Application Priority Data

Nov. 21, 1990 [JP] Japan ..... 2-317500

[51] Int. Cl.[5] ..... B41J 19/30

[52] U.S. Cl. ..... 400/124; 400/121; 400/323; 400/320

[58] Field of Search ..... 400/320, 322, 323, 323.1, 400/121, 124

[56] References Cited

U.S. PATENT DOCUMENTS

| | | | |
|---|---|---|---|
| 4,159,882 | 7/1979 | Sanders, Jr. et al. | 400/124 |
| 4,179,223 | 12/1979 | Kwan et al. | 400/320 |
| 4,242,003 | 12/1980 | Ragen | 400/124 |
| 4,431,319 | 2/1984 | Karaki et al. | 400/124 |
| 4,758,106 | 7/1988 | Yasui et al. | 400/323 |
| 4,971,464 | 11/1990 | Skiuanai | 400/323 |

FOREIGN PATENT DOCUMENTS

| | | | |
|---|---|---|---|
| 46285 | 3/1985 | Japan | 400/323 |
| 198481 | 9/1987 | Japan | 400/323 |
| 153153 | 6/1988 | Japan | 400/323 |

OTHER PUBLICATIONS

IBM Technical Disclosure Bulletin, "Matrix Scan Printing Method" J. R. Piunichy, vol. 21, No. 1, Jun. 1978.

*Primary Examiner*—Edgar S. Burr
*Assistant Examiner*—Joseph R. Keating
*Attorney, Agent, or Firm*—Oliff & Berridge

[57] ABSTRACT

In a dot matrix type printer, a method of printing wherein successive lines are printed using a first and second plurality of print wires to print a first line in left to right and a second in right to left printing that is done in two passes over each line. When high-quality printing is required, all print wires are used in both passes with the print head being repositioned, at the start point of the first line by a feed direction adjustment to center the print wires between the previously printed dots, prior to the second pass over the two lines. The result is high-quality printed characters. In normal print, the odd print wires comprise the first plurality of print wires used in the first pass and the even print wire comprise the second plurality used in the second pass over the two lines.

15 Claims, 8 Drawing Sheets

DOT PRINTING METHOD FOR DOT PRINTER

BACKGROUND OF THE INVENTION

1. Field of the Invention

The present invention relates to a dot printing method for a dot printer which prints characters, marks or graphic patterns by using dot element such as mechanical type, electrical type or chemical type, and particularly to a dot printing method for executing high-quality printing.

2. Description of Related Art

Conventionally, dot printers, such as impact type, electrostatic type, thermal type and inkjet type are well known. A method for executing high-quality printing using the above-mentioned dot printers is disclosed in Japanese Patent Publication No. 56-6032. According to the print method, a printing operation is executed twice in order to print characters, marks or graph patterns corresponding to one line. That is, in order to print odd dots in a column direction with dot elements of a print head, a first printing operation is executed while moving the print head in a row direction. Next, the print head and a sheet are relatively displaced by a small amount in the column direction. Finally, a second printing operation is executed while moving the print head in the row direction in order to print even dots in the column direction, that is at positions between the printed odd dots. The result is high-quality printing because the dots are printed close together producing a darker image.

In the dot printing method, there are two types of print method to execute two printing operations in the row direction. A first type of print method is as follows. First, during the displacement of the print head from the left side to the right side of the row or printing line, the first printing operation is executed. Next, when the print head is returned from the right side to the left side of the row, the second printing operation is executed. Using this first method, high-speed printing can be carried out. However, shifts or deviations in printing positions between the odd dots and the even dots in the column direction result due to problems such as backlash in the mechanism for displacing the print head in the row direction and low accuracy in the stop positions of the motor driving the mechanism. Consequently, the quality of dot printing is reduced.

A second type of the print method is as follows. First, when the print head is displaced from the left side to the right side of the row or printing line, the first printing operation is executed. Next, the print head is returned from the right side to the left side without executing a printing operation. Finally, the print head is again displaced from the left side to the right side as the second printing operation is executed. According to this second method, high-quality printing can be carried out. However, in order to execute two printing operations, the print head has to be displaced three times along the row or printing line, thereby reducing the dot printing speed.

SUMMARY OF THE INVENTION

An object of the invention is to provide a dot printing method which can carry out high-quality printing at a high speed.

To achieve the above-mentioned object, a dot printing method for a dot printer having a print head which has a plurality of dot print elements arranged at equal intervals in a predetermined direction, driving means for driving the dot print elements of the print head, head displacing means for reciprocally moving the print head along a printing line perpendicular to the predetermined direction, relative displacing means for relatively displacing at least one of the print head and a sheet to be printed in the predetermined direction, memory means for storing at least dot patterns corresponding to two lines including a odd line and an even line, and control means for controlling the driving means, the head displacing means, and the relative displacing means based on the dot patterns stored in the memory means, the dot printing method for the dot printer comprising the following steps:

a first step of driving the dot print elements by the driving means so as to print one part of the dot patterns corresponding to the odd line stored in the memory means while displacing the print head in a first direction along the printing line by the head displacing means;

a second step of relatively displacing at least one of the print head and the sheet in the predetermined direction by the relative displacing means thereby to hold the print head in alignment with the even line;

a third step of driving the dot print elements by the driving means so as to print one part of the dot patterns corresponding to the even line stored in the memory means while displacing the print head in a second direction opposite to the first direction along the printing line by the head displacing means;

a fourth step of relatively displacing at least one of the print head and the sheet in a direction opposite to the predetermined direction by the relative displacing means thereby to hold the print head in alignment with the odd line;

a fifth step of driving the dot print elements by the driving means so as to print another part of the dot patterns corresponding to the odd line stored in the memory means while displacing the print head in the first direction along the printing line by the head displacing means;

a sixth step of relatively displacing at least one of the print head and sheet in the predetermined direction by the relative displacing means thereby to hold the print head in alignment with the even line; and a seventh step of driving the dot print elements by the driving means so as to print another part of the dot patterns corresponding to the even line stored in the memory means while displacing the print head in the second direction along the printing line by the head displacing means.

In the dot printing method of the present invention, in the first step, the dot print elements are driven while the print head is displaced in the first direction along the printing line. As a result, one part of the dot patterns corresponding to the odd line is printed. In the second step, at least one of the print head and the sheet is relatively displaced in the predetermined direction so that the print head is held in alignment with the even line. In the third step, the dot print elements are driven while the print head is displaced in the second direction opposite to the first direction along the printing line. As a result, one part of the dot patterns corresponding to the even line is printed. In the fourth step, at least one of the print head and the sheet is relatively displaced in the predetermined direction so that the print head is held in alignment with the odd line. In the fifth step, the dot print elements are driven while the print head is displaced in the first direction along the printing line. As a result, another part of the dot patterns corresponding to the odd line is printed. In the sixth step, at least one of the print head and the sheet is relatively displaced in the predetermined direction so that the print head is held in alignment with the even line. In the seventh step, the dot print elements are driven while the print head is displaced in the second direction along the printing line. As a result, another part of the dot patterns corresponding to the even line is printed.

According to the dot printing method of the present invention, the printing operation for the odd line is executed in the first step and the fifth step. In the first step and fifth step, the direction in which the print head is displaced along the printing line is the same direction as the first direction. Therefore, there is no shift or deviation in the printing positions. The printing operation for the even line is executed in the third step and the seventh step. In the third step and seventh step, the direction in which the print head is displaced along the printing line is the same direction as the second direction. Therefore, there is no shift or deviation in the printing positions. In addition, the print head is not displaced along the printing line without executing the printing operation. In other words, while the print head is displaced in the row direction, the printing operation is executed. Consequently, according to the dot printing method of the invention, high-quality printing is carried out at a high speed.

BRIEF DESCRIPTION OF THE DRAWINGS

A preferred embodiment of the invention will be described in detail with reference to the following figures wherein.

DETAILED DESCRIPTION OF THE PREFERRED EMBODIMENT

An embodiment of the invention will be described with reference to FIGS. 1 through 5.

Figure 1:
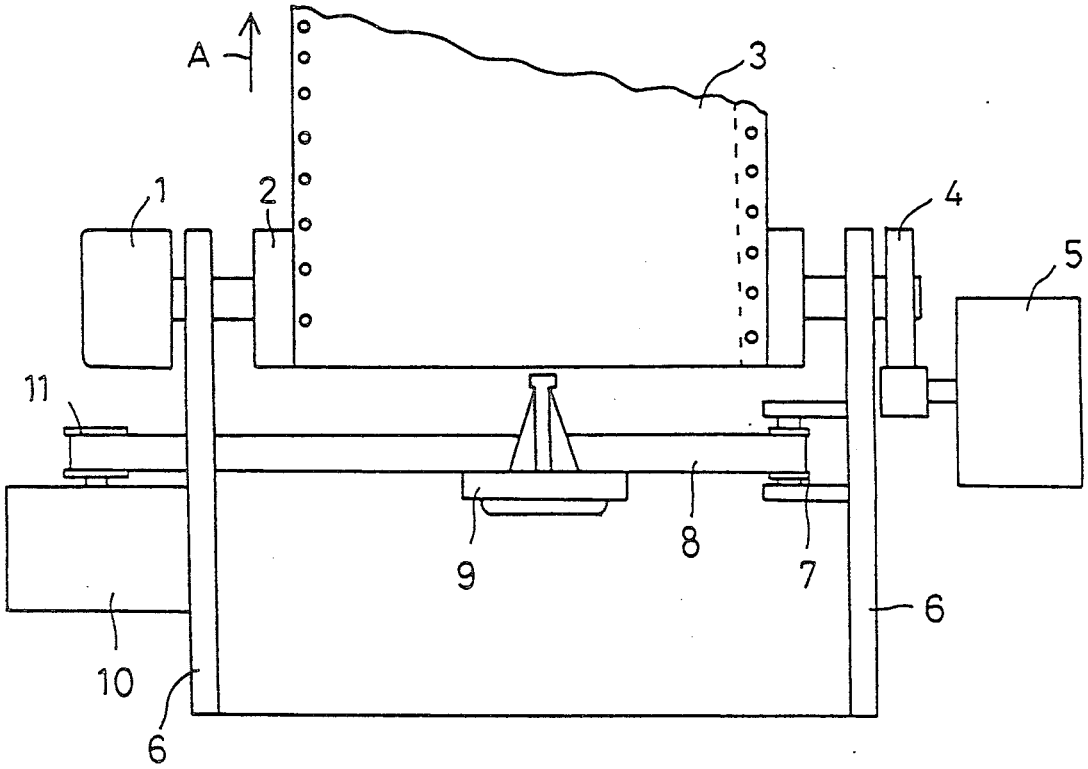
FIG. 1 is a diagram schematically showing a mechanism of a printer of the invention.

FIG. 1 is a diagram schematically showing the structure of a printer. Referring to FIG. 1, a platen 2 is rotatably supported through bearings between a pair of side frames 6. A platen knob 1 is fixedly secured to a left distal end of the platen 2. The platen 2 can be rotated in response to rotation of the platen knob 1. The platen 2 has a gear 4 fixed to its right distal end to which a line feed motor 5 is coupled. The line feed motor 5 is energized to rotate the platen 2, thereby delivering a sheet 3, supported on the platen 2, in a desired direction. A relative displacing means of the present invention comprises the platen 2, the gear 4, and the line feed motor 5.

Figure 6:
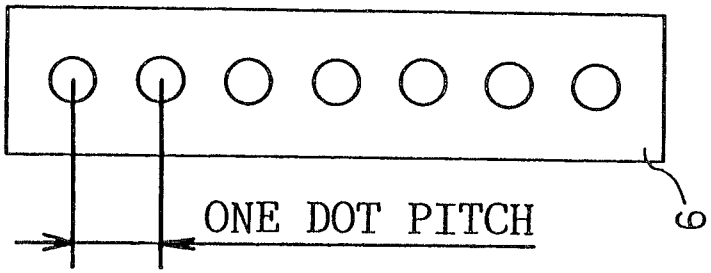
FIG. 6 shows a print head with a vertical array of print wires.

A pulley 7 is rotatably supported on the right-side frame 6 at a position below the platen 2 as shown in FIG. 1. In addition, a carriage motor 10 is mounted on the left-side frame 6 at a position below the platen 2, and a pulley 11 is supported on a shaft of the carriage motor 10. A drive belt 8 is trained around the pulleys 7 and 11. A print head 9 is fixedly secured to a part of the drive belt 8. The print head 9 has nine print wires as dot print elements arranged vertically (FIG. 6), and electromagnets for driving the print wires respectively. An ink ribbon (not shown) is disposed along a printing line between the sheet 3 and the print head 9.

When the print wires are driven by the electromagnets, the respective print wires are projected toward the ink ribbon so that dots are printed on the sheet 3. Then, the carriage motor 10 is rotated either clockwise or counterclockwise to turn the drive belt 8 in either the left or right direction (as shown in FIG. 1), thereby displacing the print head 9 in either the left or right directions along the platen 2. A head displacing means comprises the pulleys 7 and 11, the drive belt 8, and the carriage motor 10.

Figure 2:
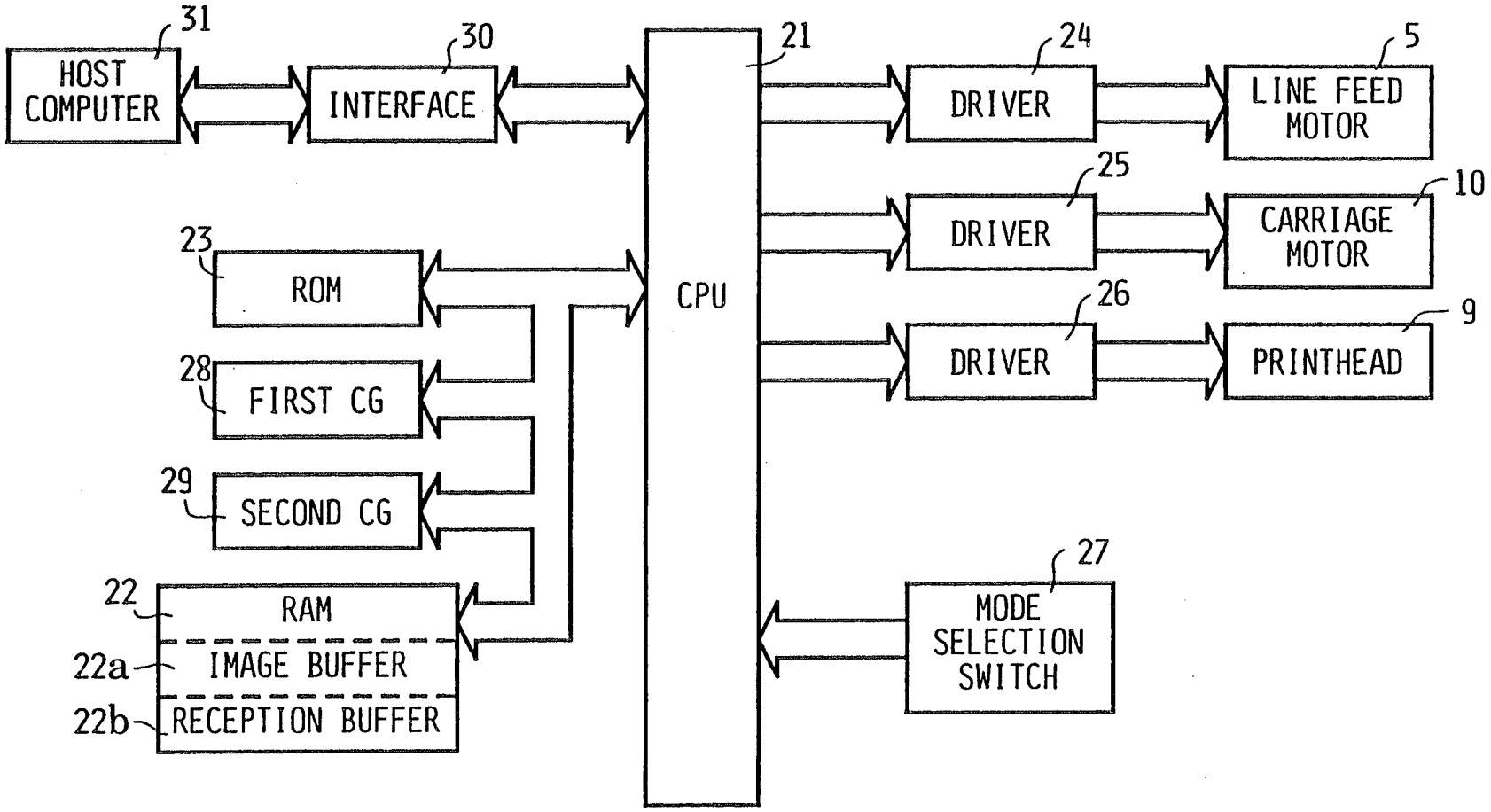
FIG. 2 is a block diagram showing an electrical structure of the printer.

FIG. 2 is a block diagram showing an electrical structure of the printer. A control circuit principally comprises a CPU 21, a ROM 23, and a RAM 22. The RAM 22 and the ROM 23 are electrically connected to the CPU 21. The line feed motor 5, the carriage motor 10, and the print head 9 are coupled, through respective drivers 24, 25, 26, to the CPU 21. In addition, a mode selection switch 27 for selecting either a normal mode or a high-quality mode, to be described later, a first character generator (hereinafter called "first CG") 28, storing therein dot patterns used in the normal mode, and a second character generator (hereinafter called "second CG") 29, storing therein dot patterns used in the high-quality mode, are connected to the CPU 21. Further, a host computer 31 for inputting data to the CPU 21 and displaying input character data and control data to include the normal mode or the high-quality mode, is connected to the CPU 21 through an interface 30. A control means of the present invention comprises the CPU 21.

The RAM 22 includes a reception buffer 22*b*, for temporarily storing therein the character data and the control data output from the host computer 31, and an image buffer 22*a*, for storing dot patterns corresponding to two lines of the input character data.

Figure 4:
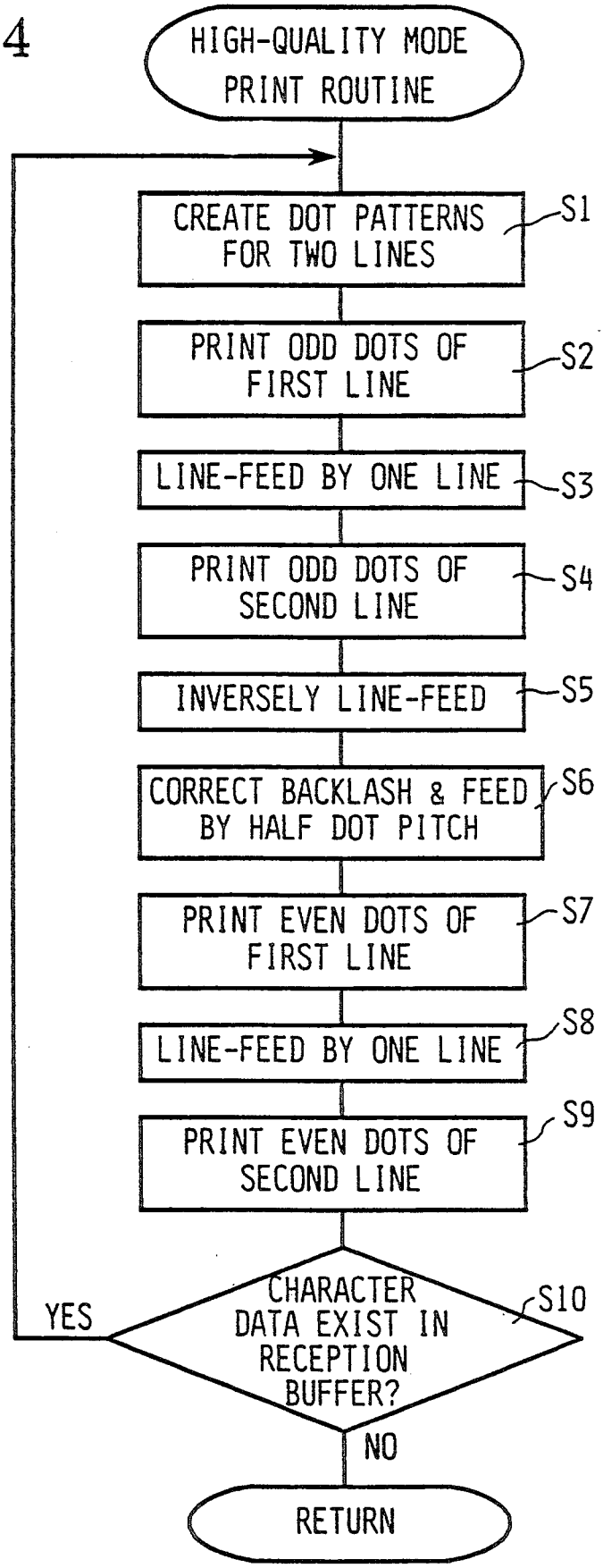
FIG. 4 is a flowchart showing the process for a print routine in the high-quality mode.

The ROM 23 contains programs for controlling various units in the printer to include the high-quality mode print routine represented by the flowchart of FIG. 4.

The first CG 28 and the second CG 29 respectively store dot patterns corresponding to and associated with respective character codes.

The mode selection switch 27 is used to select either the normal mode or the high-quality mode and is provided on a switch panel (not shown) of the printer.

Figure 3:
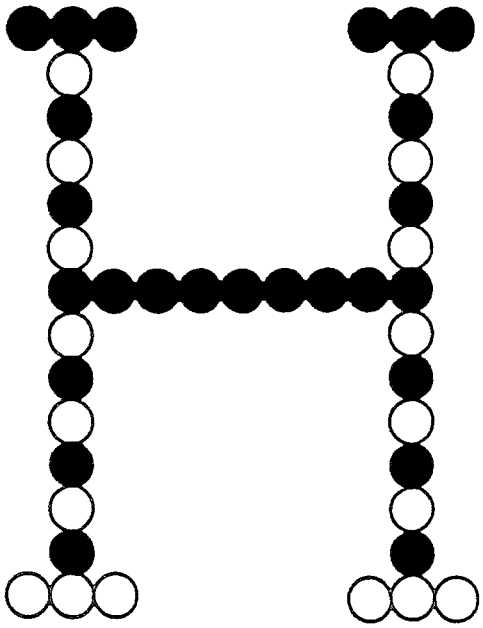
FIG. 3 is a diagram showing a high-quality mode.

Incidentally, the normal mode is used to print characters comprising seven dots extending in the longitudinal (column) direction and seven dots extending in the transverse (row) direction by using the above-mentioned print head 9. The high-quality mode is used to increase the number of dots used for formation of characters and to illuminate intervals between adjacent respective dots which are formed in characters printed in the normal mode. In the high-quality mode, characters corresponding to one line are printed by two printing operations using the print head 9. As shown in FIG. 3, by way of example, "H" is represented by 14 dots in the longitudinal direction and 11 dots in the transverse direction in the high-quality mode. The character "H" is printed in two steps by first printing using the odd dots indicated by the "black circles" in FIG. 3, and second printing using the even dots indicated by the "white circles" in FIG. 3.

Operation of the printer of the invention will be described with reference to the flowchart shown in FIG. 4 wherein Si (i=1, 2, 3, . . . ) identifies the steps.

When power is supplied to the printer and a predetermined initialization is completed, the CPU 21 waits for data from the host computer 31, electrically connected through the interface 30, and causes the reception buffer **22*b*, of the RAM 22 to successively store control data and character data input from the host computer 31. When a predetermined amount of data is stored in the reception buffer 22*b*, the CPU 21 sequentially reads the data from the reception buffer 22*b*. When the thus read data consists of control data designating a normal print mode and the normal mode is selected by the mode selection switch 27, the CPU 21 reads a dot pattern corresponding to the character data out of the associated data from the first CG 28 and stores the pattern data in the image buffer 22*a*. When dot patterns corresponding to two lines of character data are stored in the image buffer 22*a*, the CPU 21 drives the print head 9 to print the characters on the sheet 3**.

On the other hand, when the high-quality mode is designated by control data input from the host computer 31, and the high-quality mode is selected by the mode selection switch 27 on the printer, the CPU 21 executes a high-quality mode print routine shown in FIG. 4. If the mode input from the host computer 31 differs from that of the mode selection switch 27, the mode input by the host computer 31 prevails. If no mode is input through the host computer 31, the mode set by the mode selection switch 27 on the printer determines the print mode.

The CPU 21 first reads the character data from the RAM 22 and then reads dot patterns, corresponding to the respective character data, from the second CG 29 to store the character dot patterns in the image buffer **22*a* to produce dot patterns corresponding to two lines (Step S1). Assuming that the characters of the two lines are all "H", dot patterns are produced such that the character "H" is printed, for example, in a group of four characters "H" on each of the two lines, as shown in FIG. 5D. The CPU 21 rotates the carriage motor 10 to drive the print head 9 to displace from the left end to the right end of the first line, i.e., displace the print head 9 from a point B to a point C as indicated by a locus T1 in FIG. 5A, while printing the odd dots corresponding to a first line on the sheet 3 (Step S2). When the procedure in Step S2 is executed, only odd dots of the character "H" in the first line in the high-quality mode are printed on the sheet 3**.

The CPU 21 then rotates the line feed motor 5, without energizing the carriage motor 10, and feeds the sheet 3 a predetermined distance or length in the direction indicated by the arrow A in FIG. 1, thereby feeding one line (Step S3). Such a line feed relatively displaces the print head 9 from a position corresponding to the point C to a position corresponding to point D as indicated by a locus T2 in FIG. 5B. As a consequence, the print head 9 is aligned with the position where the second line is to be printed.

Figure 5A:
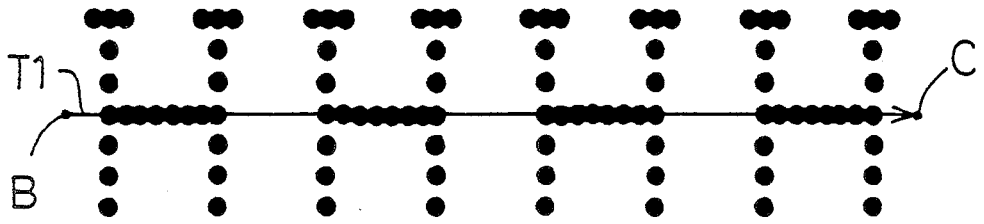
FIG. 5A is a diagram showing the printing operation in the high-quality mode, step 1.
Figure 5B:
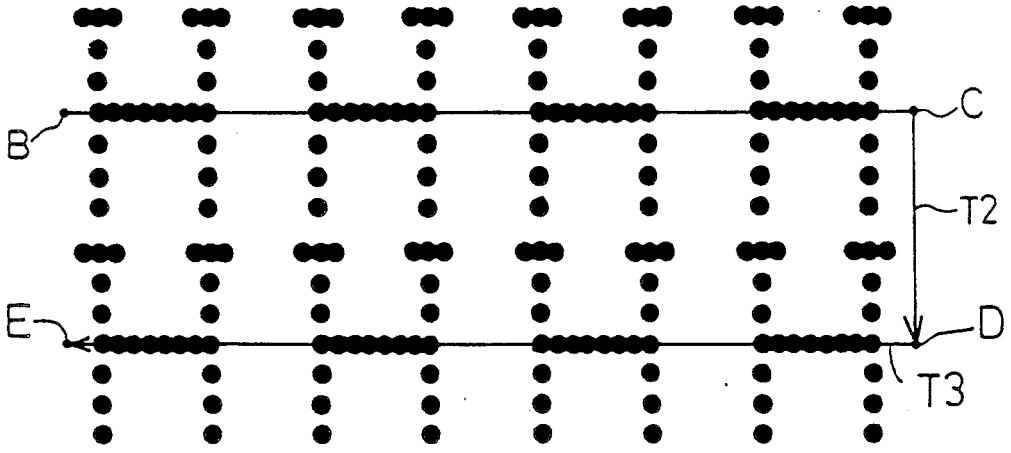
FIG. 5B is a diagram showing the printing operation in the high-quality mode, step 3.

The CPU 21 is activated to reverse the carriage motor 10 so as to operate the print head 9 while displacing it from the left end of the printing line to the right end, i.e., displacing the print head 9 from the point D to a point E, as indicated by a locus T3 in FIG. 5B, thereby printing odd dots corresponding to the second line on the sheet 3 (Step S4). When the procedure of Step S4 is executed, only odd dots of the character "H" in the second line are printed on the sheet 3.

Figure 5C:
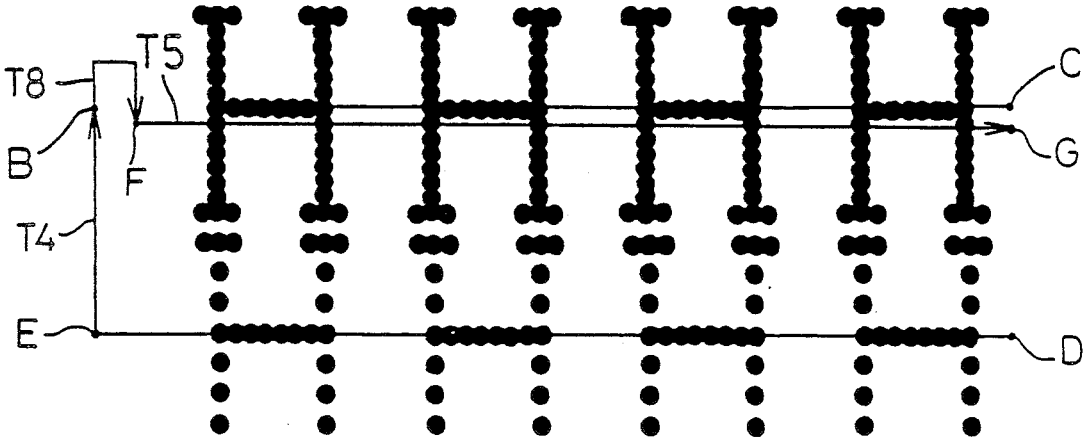
FIG. 5C is a diagram showing the printing operation in the high-quality mode, step 5.
Figure 5D:
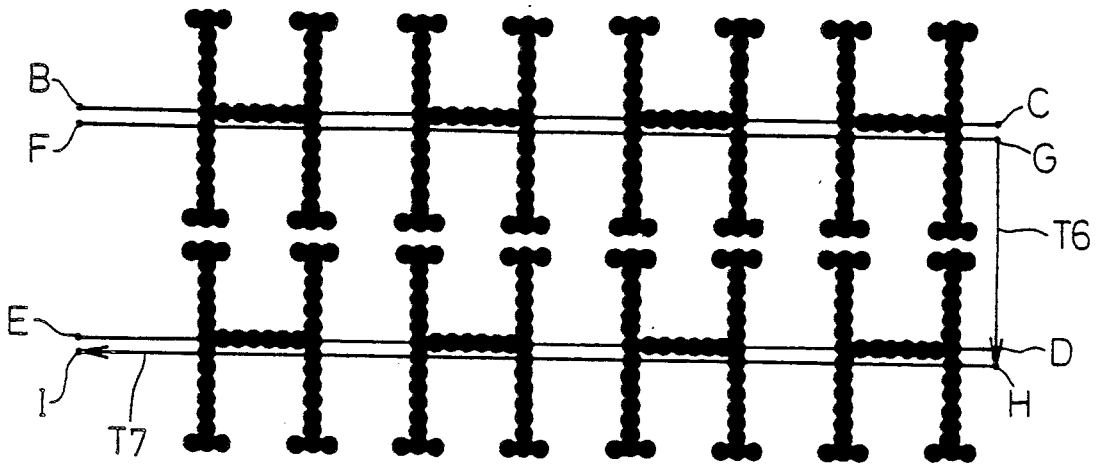
FIG. 5D is a diagram showing the printing operation in the high-quality mode, step 7.

After the procedure in Step S4 has been executed, the CPU 21 reverses the line feed motor 5, without energizing the carriage motor 10, to feed the sheet 3 through the predetermined distance in a direction opposite to the direction indicated by the arrow A in FIG. 1, that is, the paper feed direction, thereby inversely feeding one line to return to the preceding line (Step S5). Then, the CPU 21 reverses the line feed motor 5 so as to further feed the sheet 3 by a slight amount or length in the direction opposite to the direction indicated by the arrow A in FIG. 1. Thereafter, the CPU 21 normally rotates the line feed motor 5 so as to feed the sheet 3 by a length obtained by adding a length corresponding to one half of one dot pitch to the slight length, in the direction indicated by the arrow A in FIG. 1 (Step S6). When the procedure of each of Steps S5 and S6 is executed, the print head 9 makes a relative displacement from the point E to the point B as indicated by a locus T4 in FIG. 5C. Then, the print head 9 makes a displacement from the point B to a point F shifted by half of one dot pitch in the direction indicated by the arrow A in FIG. 1 from the point B as indicated by a locus T8 in FIG. 5C. Although FIG. 5C shows a slight displacement along the printing line between point B and point F, the actual displacement is only in the line feed direction, as represented by arrow A in FIG. 1, or the reverse direction. When the procedure of Step S6 is executed, the line feed motor 5 is reversed to correct a backlash defined between the line feed motor 5 and the platen 2, so that the print head 9 is accurately held in alignment with the point F.

The CPU 21 normally rotates the carriage motor 10 again so as to drive the print head 9 while moving the same from the left end to the right end of the printing line, i.e., displacing the same from the point F to the point G as indicated by the locus T5 in FIG. 5C, thereby printing even dots of the first line on the sheet 3 (Step S7). When the routine procedure in Step S7 is executed, the even dots are printed on the sheet 3 on which the odd dots of the first line have already been printed, so that the character "H" in the high-quality mode is fully printed on the sheet 3.

Then, the CPU 21 directs normal rotation of the line feed motor 5, without energizing the carriage motor 10, in the same manner as in Step S3 to feed the sheet 3 through a predetermined length in the direction indicated by the arrow A in FIG. 1, thereby feeding one line (Step S8). When the one line feeding process is completed, the print head 9 has made a relative displacement from a position corresponding to the point G to a point H as indicated by a locus T6 in FIG. 5D. Thus, the print head 9 is again held in alignment with a printing position on the second line.

The CPU 21 again reverses the carriage motor 10 to operate the print head 9 while displacing it from the right end to the left end of the printing line, i.e., moving it from the point H to the point I as indicated by a locus T7 in FIG. 5D, thereby printing even dots of the second line on the sheet 3 (Step S9). When the routine procedure in Step S7 is executed, the even dots are printed on the sheet 3 on which the odd dots of the second line have already been printed. Thus, the character "H" in the high-quality mode is completely printed on the sheet 3.

After the procedure of each of Steps S1 to S9 is executed, and two lines are printed, the CPU 21 determines whether or not character data to be printed in the high-quality mode are again contained in the reception buffer 22*b* of the RAM 22 (Step S10). If it is determined to be Yes in Step S10, then Steps S1 to S9 are again executed to print the next two lines. If it is determined to be No in Step S10, then the high-quality mode print routine is completed.

As described above, the printer according to the present embodiment can avoid any displacement of a print operation-free print head as is encountered with the conventional apparatus. Therefore, characters of high quality can be printed at a high speed. Since the first printing and the second printing are carried out at all times in the same printing direction, no printing shift or dislocation is produced in the high-quality mode under which plural passes are used to print characters.

The invention is not necessarily limited to the above-described embodiment. Many changes and modifications can be made without departing from the spirit or scope of the invention as set forth herein.

In the above-described embodiment, only two lines of the dot patterns are stored in the image buffer. However, dots patterns corresponding to four or six lines may be stored therein. In this case, only the odd dots are sequentially printed on a sheet for the four or six lines. When the odd dot four to six lines are printed, the print head is inversely line-fed up to the first line and the even dot lines are printed on the sheet starting with the first line.

In addition, either odd dots or even dots may be printed first.

The dot printing method according to the present invention can be used in a modified normal print mode using a first printing with only the odd pins and a second printing using only even pins or the converse. In this case, it is possible to carry out a sound-reduced printing with the printer and to activate the printer with less power consumption.

What is claimed is:

1. A dot printing method for a dot printer including a print head which has a plurality of dot print elements arranged at equal intervals in a predetermined direction, driving means for driving said dot print elements of said print head, head displacing means for reciprocally moving said print head along a printing line perpendicular to said predetermined direction, relative displacing means for relatively displacing at least one of said print head and a sheet to be printed in said predetermined direction, memory means for storing at least dot patterns corresponding to two lines including a odd line and an even line, and control means for controlling said driving means, said head displacing means, and said relative displacing means based on the dot patterns stored in said memory means, said dot printing method for said dot printer comprising:

a first step of driving said dot print elements by said driving means so as to print one part of the dot patterns corresponding to the odd line stored in said memory means while displacing said print head in a first direction along the printing line by said head displacing means;

a second step of relatively displacing at least one of said print head and the sheet in said predetermined direction by said relative displacing means thereby to hold said print head in alignment with the even line;

a third step of driving said dot print elements by said driving means so as to print one part of the dot patterns corresponding to the even line stored in said memory means while displacing said print head in a second direction opposite to said first direction along the printing line by said head displacing means;

a fourth step of relatively displacing at least one of said print head and the sheet in a direction opposite to said predetermined direction by said relative displacing means thereby to hold said print head in alignment with the odd line;

a fifth step of driving said dot print elements by said driving means so as to print another part of the dot patterns corresponding to the odd line stored in said memory means while displacing said print head in said first direction along the printing line by said head displacing means;

a sixth step of relatively displacing at least one of said print head and the sheet in said predetermined direction by said relative displacing means thereby to hold said print head in alignment with the even line; and a seventh step of driving said dot print elements by said driving means so as to print another part of the dot patterns corresponding to the even line stored in said memory means while displacing said print head in said second direction along the printing line by said head displacing means.

2. The dot printing method according to claim 1, wherein the dot patterns stored in said memory means having odd dots and even dots alternately aligned in said predetermined direction.

3. The dot printing method according to claim 2, wherein said first step includes a step of printing the odd dots of the dot patterns corresponding to the odd line stored in said memory means, and wherein said third step includes a step of printing the odd dots of the dot patterns corresponding to the even line stored in said memory means.

4. The dot printing method according to claim 2, wherein said fifth step includes a step of printing the even dots of the dot patterns corresponding to the odd line stored in said memory means, and wherein said seventh step includes a step of printing the even dots of the dot patterns corresponding to the even line stored in said memory means.

5. A method of printing using a dot matrix type printer, comprising the steps of:

aligning a print head of the printer at a first end of a first line;

printing the first line in a first direction using a first plurality of dot print elements in the print head;

feeding a print medium in a feed direction to position the print head at a second end of a second line;

printing the second line in a second direction opposite to the first direction using the first plurality of dot print elements;

reverse feeding the print medium in an opposite direction to the feed direction to reposition the print head at the first end of the first line;

overprinting the first line in the first direction using a second plurality of dot print elements;

feeding the print medium in a feed direction to reposition the print head at the second end of the second line; and overprinting the second line in the second direction using the second plurality of dot print element.

6. The method of printing according claim 5, further comprising the step of selecting between a high-quality print mode and a normal print mode before said aligning step.

7. The method according to claim 6, further comprising the step of incremently reverse feeding the print medium in the direction opposite to the feed directed to position a centerline of the print head a dot width below a centerline position resulting from the step of aligning the print head, the incremently reverse feeding step occurring immediately after the reverse feeding step when the high-quality print mode is selected.

8. The method according to claim 6, wherein said first and second plurality of print elements comprise the same plurality of print elements when the high-quality print mode is selected.

9. The method according to claim 6, wherein said first plurality of printed elements comprise odd-numbered print elements and said second plurality of print elements comprise even-numbered print elements when the normal print mode is selected.

10. The method according to claim 5, further comprising inserting the steps of:

feeding the print medium in a feed direction to position the print head at a first end of a third line;

printing the third line in the first direction using the first plurality of dot print elements;

feeding a print medium in a feed direction to position the print head at a second end of a fourth line; and printing the fourth line in the second direction using the first plurality of dot print elements after the step of printing the second line; and inserting the steps of:

feeding the print medium to position the print head at a first end of the third line;

overprinting the third line in the first direction using the second plurality of print elements;

feeding the print medium in a print direction to reposition the print head at a second end of a fourth line; and overprinting the fourth line in the second direction using the second plurality of dot print elements after the step of overprinting the second line.

11. The method of printing according claim 10, further comprising the step of selecting between a high-quality print mode and a normal print mode before said aligning step.

12. The method according to claim 10, further comprising the step of incremently reverse feeding the print medium in the direction opposite to the feed directed to position a centerline of the print head a dot width below a centerline position resulting from the step of aligning the print head, the incremently reverse feeding step occurring immediately after the reverse feeding step when the high-quality print mode is selected.

13. The method according to claim 11, wherein said first and second plurality of print element comprise the same plurality of print elements when the high-quality print mode is selected.

14. The method according to claim 11, wherein said first plurality of printed elements comprise odd-numbered print elements and said second plurality of print elements comprise even-numbered print elements when the normal print mode is selected.

15. The method according to claim 10, further comprising repeating the enumerated steps for each additional pair of odd and even numbered lines for which print data is available.

* * * * *